US006731765B1

(12) United States Patent
Sotome

(10) Patent No.: US 6,731,765 B1
(45) Date of Patent: May 4, 2004

(54) LOUDSPEAKER DEVICE

(75) Inventor: Hiromi Sotome, Hamamatsu (JP)

(73) Assignee: Yamaha Corporation, Hamamatsu (JP)

( * ) Notice: Subject to any disclaimer, the term of this patent is extended or adjusted under 35 U.S.C. 154(b) by 0 days.

(21) Appl. No.: 08/935,476

(22) Filed: Sep. 24, 1997

(30) Foreign Application Priority Data

Sep. 26, 1996 (JP) ..... 8/254925

(51) Int. Cl.[7] ..... H04R 25/00

(52) U.S. Cl. ..... 381/160; 381/300; 381/186; 381/182

(58) Field of Search ..... 381/24, 188, 205, 381/160, 186, 182, 300; 181/144, 155, 199

(56) References Cited

U.S. PATENT DOCUMENTS 3,824,343 A * 7/1974 Dahlquist ..... 381/386
4,805,731 A * 2/1989 Staley ..... 381/160
5,416,284 A * 5/1995 Steele ..... 181/199
5,590,214 A * 12/1996 Nakamura ..... 381/188
5,590,771 A * 1/1997 Cota ..... 381/24

FOREIGN PATENT DOCUMENTS

JP 5854184 4/1983 ..... H04R/1/02
JP 0218298 * 8/1989 ..... 181/199

* cited by examiner

*Primary Examiner*—Minsun Oh Harvey
(74) *Attorney, Agent, or Firm*—Pillsbury Winthrop LLP

(57) ABSTRACT

A loudspeaker device includes left and right channel loudspeaker units which are disposed on left and right sides in close proximity to each other, and a partition member projecting forwardly in the direction of propagation of sound from the loudspeaker units by a predetermined distance from a position between the loudspeaker units on a plane of a baffle on which the loudspeaker units are mounted.

17 Claims, 3 Drawing Sheets

LOUDSPEAKER DEVICE

BACKGROUND OF THE INVENTION

This invention relates to a loudspeaker device of a stereophonic dipole system (hereinafter referred to as "SD system" in which no acoustic short-circuiting takes place in a case where left side and right side loudspeakers are disposed in close proximity to each other.

In a conventional loudspeaker device for stereophonic audio reproduction, left side and right side loudspeakers are disposed in front of a listener and with a certain distance provided between the two loudspeakers.

A loudspeaker device called SD system has recently been proposed. A brief explanation will be made about the reproduction principle of the SD system.

The SD system is basically composed of a digital filter network inserted immediately before an amplifying power amplifier in the reproduction system and two loudspeakers disposed in front of a listener in close proximity to each other. The digital filter network corresponds to standard stereophonic, monaural and binaural sources as their input sources. For these input signals, the digital filter network has a function of cancelling a crosstalk sound which reaches from the right channel to the left channel (or from the left channel to the right channel) and produces two channel outputs after subjecting the input signals to this filtering processing. By amplifying these outputs and supplying them to the two loudspeakers which are disposed in front of a listener in close proximity to each other for reproduction, a virtual reality sound field space is produced in front of the listener. This SD system is advantageous in that, in comparison with the conventional loudspeaker device, it has a broader listenable area and a broader allowable range for moving of the listener's head during reproduction.

Further, as a result of passing through the above described digital filter network, the output sound reaches the listener's ear with the harmful component called the crosstalk sound being cancelled, so that a high fidelity reproduction of music can be realized.

In the above described SD system, however, there occurrs a problem that, since the loudspeakers are disposed in close proximity to each other, opposite phase components of left and right channel signals are acoustically short-circuited to cancel each other in the vicinity of loudspeaker units immediately after generation of these signals and, therefore, these components do not reach the listener's ear. Particularly, occurrence of this phenomenon in middle and low frequency sound ranges which have a broad directivity in reproduction prevents propagation of a reproduced sound over a broad range and also reduces the sound pressure level of a reproduced sound in the middle and low frequency sound ranges.

It is, therefore, an object of the invention to provide a loudspeaker device of the SD system in which opposite phase components of left and right channel signals do not cancel each other.

SUMMARY OF THE INVENTION

For achieving the above described object of the invention, there is provided a loudspeaker device comprising left and right channel loudspeaker units which are disposed on left and right sides in close proximity to each other, and a partition member projecting forwardly in the direction of propagation of sound from the loudspeaker units by a predetermined distance from a position between the loudspeaker units on a plane of a baffle on which the loudspeaker units are mounted.

In one aspect of the invention, in the loudspeaker device, said left and right channel loudspeaker units are respectively mounted on independent loudspeaker enclosures and these left and right loudspeaker enclosures which constitute a pair are disposed adjacent to each other to be integrated together and said partition member is disposed on a plane on which the loudspeaker enclosures are disposed adjacent to each other.

In another aspect of the invention, there is provided a loudspeaker device comprising left and right channel loudspeaker units of a full frequency range type or a middle and low frequency range type disposed in proximity to each other on a first baffle plane, a loudspeaker unit for a low-frequency sound used commonly for the left and right channels mounted on a second baffle plane which is located forwardly in the direction of propagation of sound from the loudspeaker units from the first baffle plane, and a partition member disposed between said first baffle plane and said second baffle plane and between the loudspeaker units of the respective channels of the full frequency range type or the middle and low frequency range type.

The loudspeaker device of the SD system according to the invention has the following advantages:

1. By providing the partition member between the left and right side loudspeakers, opposite phase components of reproduced sound, particularly those in the middle and low frequency ranges do not cancel each other in the vicinity of the loudspeakers, so that the reproduced sound can be propagated over a broader range whereby reproduction by the SD system can be realized with a high fidelity and a high quality.
2. In a case where a loudspeaker cabinet is adopted in which the left and right side loudspeakers are integrally disposed, the partition member, together with a Saran (TM) net, increases the mechanical strength of the loudspeaker as a whole with resulting improvement in the quality of a reproduced sound.
3. By providing the partition member on the side of the Saran net, the Saran net can be added or replaced on a loudspeaker device which has no such Saran net and, accordingly, an acoustic effect produced by mounting the Saran net can be recognized easily.

Preferred embodiments of the invention will be described below with reference to the accompanying drawings.

BRIEF DESCRIPTION OF THE DRAWINGS

In the accompanying drawings.

DESCRIPTION OF PREFERRED EMBODIMENTS

Figure 1:
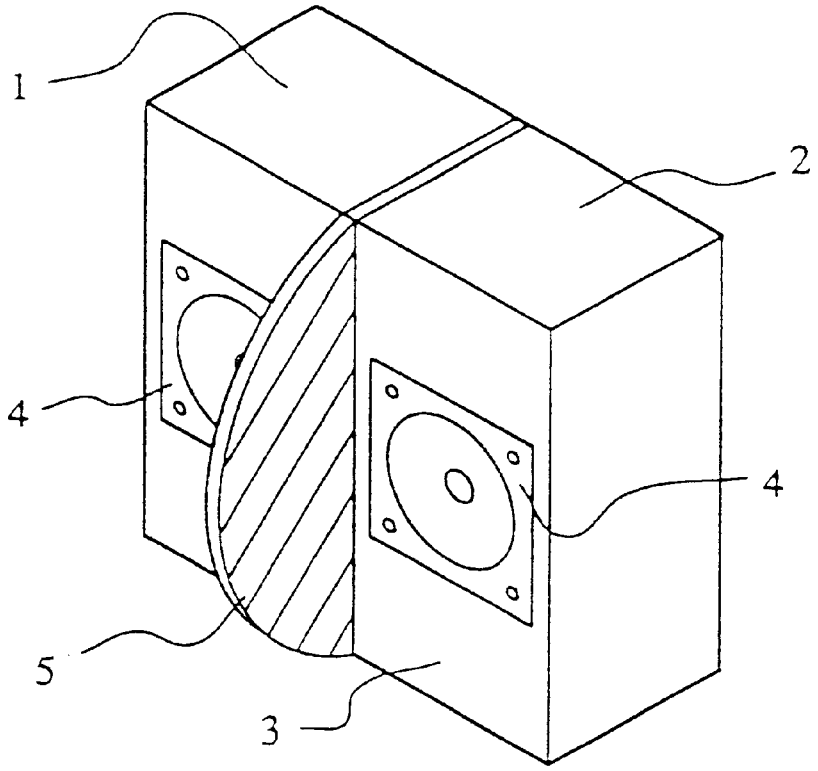
FIG. 1 is a perspective view showing a first embodiment of the loudspeaker device of the SD system made according to the invention.

FIG. 1 shows a first embodiment of the loudspeaker device according to the invention.

In this figure, reference character 1 designates a left channel loudspeaker and reference character 2 designates a right channel loudspeaker. These loudspeakers 1 and 2 are of the same construction and description will be made below with respect to the left channel loudspeaker 1 only. On a front baffle 3 of the loudspeaker 1 is mounted a full range type loudspeaker unit 4. A partition plate 5 projecting from the front baffle 3 is provided between the loudspeakers 1 and 2. This partition plate 5 is disposed in such a manner that it projects forwardly from the front baffle 3 to divide the pair of left and right loudspeaker units 4 in the center.

Figure 4A:
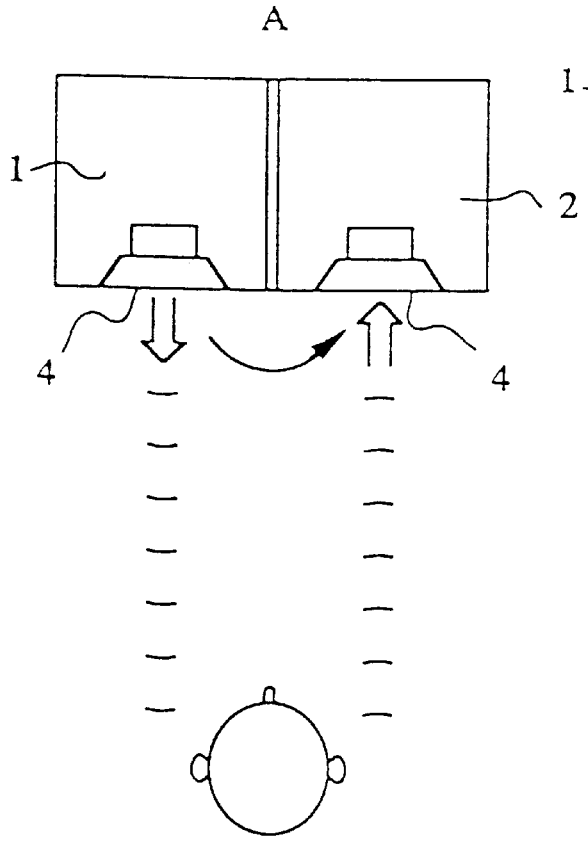
FIG. 4A is a diagram showing the function of the conventional loudspeaker device of the SD system.
Figure 4B:
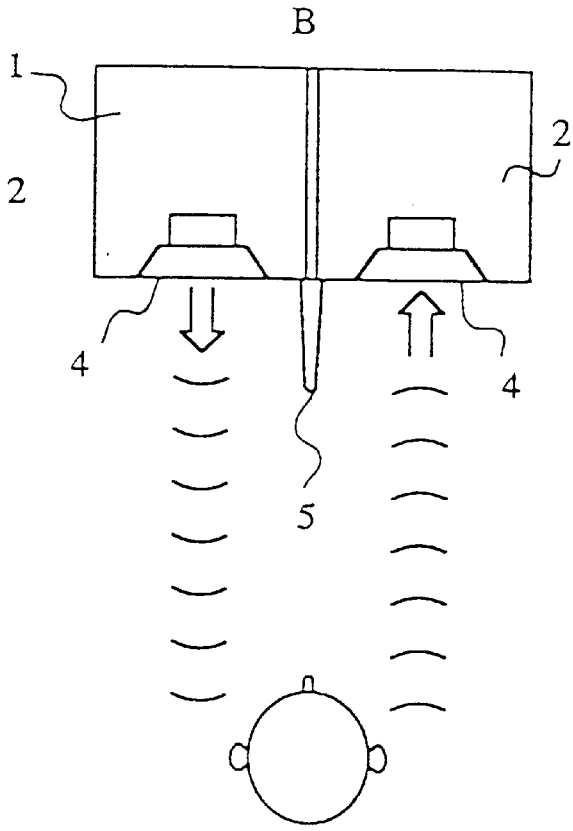
FIG. 4B is a diagram showing the function of the loudspeaker device of the SD system made according to the invention.

By performing reproduction of music by using the SD system loudspeaker device constructed in the above described manner, propagation of a sound wave of an opposite phase component from one loudspeaker 1 (or 2) to the other loudspeaker 2 (or 1) is interrupted and acoustic short-circuiting is thereby prevented. More specifically, a sound wave which is propagated through the shortest path from the loudspeaker 1 to the loudspeaker 2 as shown in FIG. 4A is interrupted by the partition plate 5 as shown in FIG. 4B. This prevents occurrence of an acoustic short-circuiting phenomenon and thereby prevents decrease in the sound pressure level due to short-circuiting, so that the sound wave can accurately reach a listening point.

For realizing the first embodiment of the loudspeaker device in a specific form, two independent loudspeaker enclosures may be provided adjacent to each other and a partition plate 5 may be mounted in the center thereof, i.e., on a plane on which these loudspeaker enclosures are disposed adjacent to each other. According to this construction, a loudspeaker device of the SD system can be readily provided by utilizing an existing loudspeaker device. Alternatively, it is possible to combine cabinets of two loudspeaker devices together in such a manner that they share a common side plate and extend this common side plate forwardly to form a partition plate 5. Further alternatively, left and right channel loudspeaker units may be mounted on an integrally formed cabinet and a partition plate 5 may be provided so that the left and right channel loudspeakers share a common partition plate 5 provided in the center. According to this construction, mechanical strength of the cabinet of the loudspeaker device can be improved and the manufacturing cost can be reduced because the number of component parts and manufacturing steps can be reduced.

Figure 2:
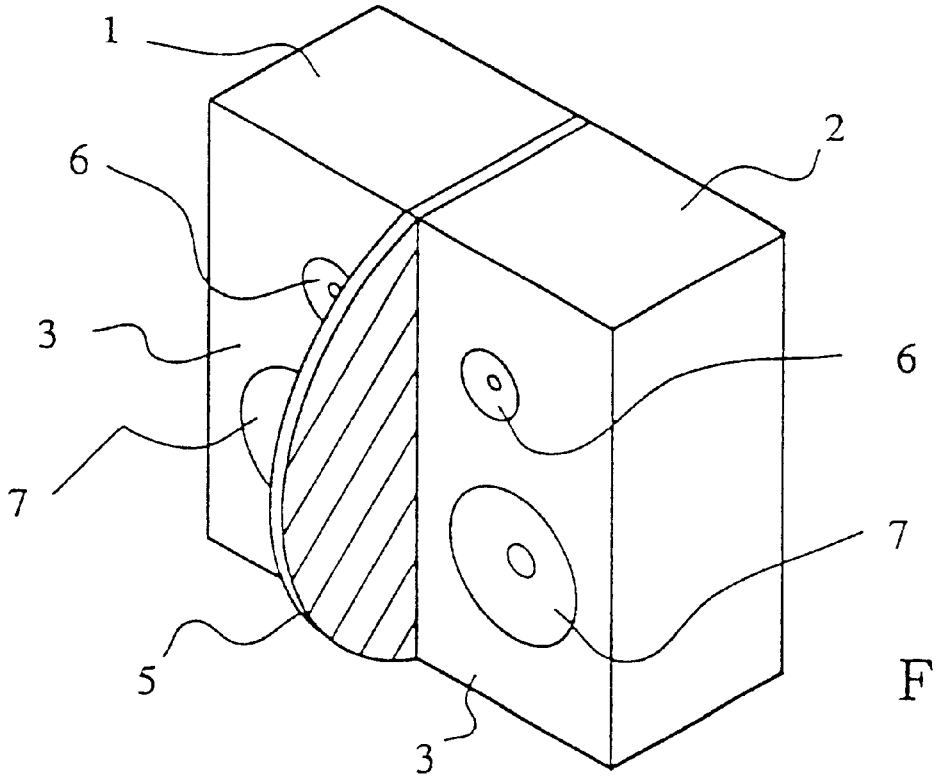
FIG. 2 is a perspective view showing a second embodiment of the loudspeaker device of the SD system made according to the invention.

FIG. 2 shows a two-way loudspeaker device which is the second embodiment of the invention.

In this figure, reference characters 1 to 3 and 5 designate the same component parts as those shown in FIG. 1. Reference character 6 designates a tweeter which is a loudspeaker unit for a high frequency sound (hereinafter simply called "tweeter") and reference character 7 designates a woofer which is a loudspeaker unit for a low frequency sound (hereinafter simply called "woofer"). In a case where, as shown in this figure, a loudspeaker of each unit consists of plural loudspeaker units, it is preferable that a partition plate 5 is provided between each pairing loudspeaker units so as to prevent interference of sound waves in each pairing loudspeaker units. In this embodiment also, various structures similar to those described with respect to the embodiment of FIG. 1 may be adopted.

Figure 3:
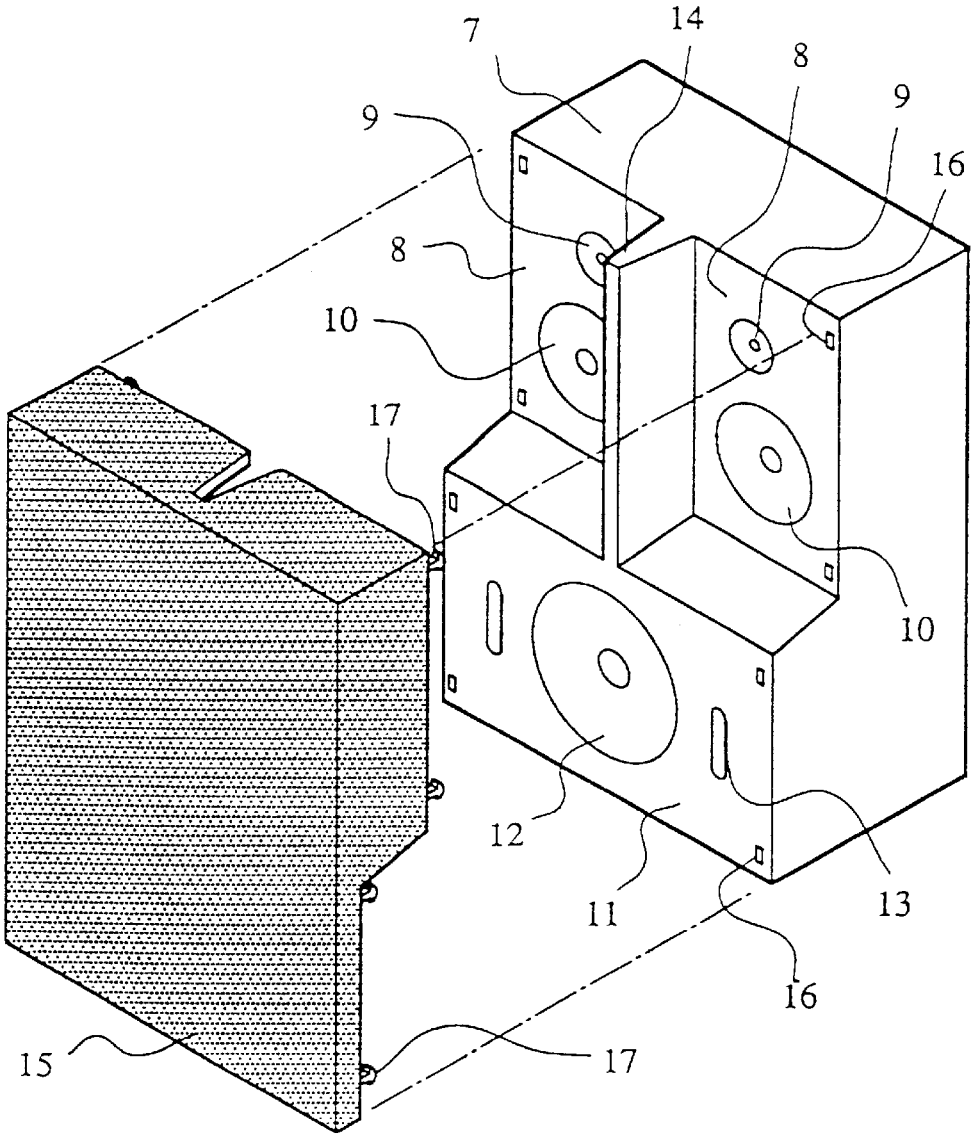
FIG. 3 is a perspective view showing a third embodiment of the loudspeaker device of the SD system made according to the invention.

As the third embodiment of the invention, a loudspeaker device having a monaural subwoofer for enhancing a low frequency sound is shown in FIG. 3. This embodiment is suitable for use in a situation in which the sound wave interference :prevention effect by the partition plate in the above described embodiments is still insufficient in a low frequency range. In this embodiment, as left and right channel loudspeaker units, a loudspeaker unit of a full range type or a loudspeaker unit of a middle and high frequency range type such as a multi-way type may be effectively used. This system has a first reproduction unit which is disposed in the upper portion of the system for reproducing mainly middle and high frequency sounds through left and right stereophonic channels and a second reproduction unit which is disposed in the lower portion of the system for monaurally reproducing a low frequency sound or a super-low frequency sound. Tweeters 9 and woofer-squawkers 10 which are loudspeakers of the first reproduction unit are mounted on a first baffle plane, i.e., front baffle 8 in the upper portion of the system and a subwoofer 12 which is a loudspeaker of the second reproduction unit is mounted on a second baffle plane which is disposed forwardly of the first baffle plane, i.e., front baffle 11 in the lower portion of the system. The front baffle 11 is formed with bass-reflex ports 13. A partition plate 14 projects from the front baffle 8. A decorative and protective Saran net 15 is detachably mounted on the two front baffles 8 and 11 by means of fitting devices 16 and 17 as illustrated which can be fittedly engaged with each other.

In this example, the subwoofer 12 addes left and right channel signals together and reproduces the added signal as a monaural signal so that a partition member for dividing the left and right loudspeaker units is not necessary. In the first reproduction unit, in the same manner as in the above described embodiments, there is provided the partition plate 14 projecting forwardly in the direction of propagation of sound from the loudspeaker unit by a predetermined distance from a position between the loudspeaker units on a plane of baffles on which the loudspeaker units are mounted. The length of projection of this partition plate 14 is adjusted so that the front end of the partition plate 14 is made flush with the second baffle plane, i.e., the front baffle 11 of the second reproduction unit. In the present invention, it is not essential that the length of projection of the partition plate 14 should be adjusted in this manner. However, by adjusting the length of projection of the partition plate 14 in this manner, an advantage to be described in C below will be derived.

By adopting the structure having the first and second reproduction units and having the front baffles 8 and 11 positioned on the first and second baffle planes, the following advantages will result:

A. In a case where sound wave interference is prevented sufficiently in middle and high frequency sound ranges by providing a partition plate between left and right channel loudspeakers which are driven by the SD system but a sufficient sound wave interference prevention effect cannot be achieved in a low frequency sound range due to bypassing of sound wave and, as a result, the sound pressure level of a reproduced sound is insufficient, the sound pressure level of a low frequency sound can be enhanced by the provision of the subwoofer in the system.

B. By suitably setting the degree of the step formed between the first reproduction unit and the second reproduction unit, a hypothetic point sound source of a middle or high frequency sound which is mainly produced by the first reproduction unit and a hypothetic point sound source of a low frequency sound which is produced by the second reproduction unit can be matched to cause phases of the respective sound waves to coincide with each other whereby matching of the reproduction characteristics can be realized.

C. By adjusting the length of projection of the partition plate 14 so that the front end of the partition plate 14 is made flush with the front baffle 11, the Saran net 15 which covers the entire front surface of the loudspeaker device is supported in its upper middle portion with resulting increase in the mounting strength of the Saran net 15. Particularly in the third embodiment in which the left and right channel loudspeakers of the first reproduction unit are received in a single system cabinet, the area of the front baffle is about double that of the conventional loudspeaker device which consists of separate left and right channel loudspeakers. By further integrating the second reproduction unit, a Saran net of a large size is required. The arrangement of matching the length of projection of the partition plate 14 with the height of the front baffle 11 is effective for maintaining the mechanical strength of such a large size Saran net.

In the above described embodiments, the partition plate is supported on the baffle plane of a loudspeaker cabinet or enclosure. In a case where a Saran net is provided further forwardly of the baffle plane, the partition plate may be supported on the Saran net side. If such a structure is used on a loudspeaker device of the SD system which has no partition plate on its baffle plane, the advantages of the present invention can be achieved without changing the design of the system itself such as a cabinet.

What is claimed is:

1. A loudspeaker device comprising:

left and right channel loudspeaker units which are disposed on left and right sides in close proximity to each other, and wherein the left and the right loudspeaker units propagate sound in a same direction of propagation; and a partition member projecting forwardly in the direction of propagation of the sound from the loudspeaker units by a predetermined distance from a position between the loudspeaker units on a plane of a baffle on which the loudspeaker units are mounted, wherein the partition member projects from an enclosure of at least one of the loudspeaker units, and is disposed perpendicular to the plane of the baffle.

2. A loudspeaker device as defined in claim 1 wherein said left and right channel loudspeaker units are respectively mounted on independent loudspeaker enclosures and these left and right loudspeaker enclosures which constitute a pair are disposed adjacent to each other to be integrated together and said partition member is disposed on a plane on which the loudspeaker enclosures are disposed adjacent to each other.

3. A loudspeaker device according to claim 2, further comprising:

a screen that is detachably mounted on the baffle of the loudspeaker device.

4. The loudspeaker device according to claim 1, wherein the left and the right loudspeaker units share a common housing.

5. The loudspeaker device according to claim 1, wherein the left and the right loudspeaker units are physically connected.

6. The loudspeaker device according to claim 1, wherein the partition member is a single partition member.

7. A loudspeaker device comprising:

left and right channel loudspeaker units of a full frequency range type or a middle and low frequency range type disposed in close proximity to each other on a first baffle plane, and wherein the left and the right loudspeaker units propagate sound in a same direction of propagation;

a loudspeaker unit, for low-frequency sound used commonly for left and right channels, mounted on a second baffle plane which is located forwardly in the direction of propagation of sound from the loudspeaker units from the first baffle plane; and a partition member disposed between said first baffle plane and said second baffle plane projecting forwardly in the direction of propagation of the sound from the first baffle plane and between the loudspeaker units of the respective channels of the full frequency range type or the middle and low frequency range type, wherein the partition member projects from an enclosure of at least one of the loudspeaker units, and is disposed perpendicular to the first baffle plane.

8. A loudspeaker device according to claim 7 wherein the partition member projects forward no greater than past the second baffle plane.

9. A loudspeaker device according to claim 8 wherein the screen is a Saran net.

10. A loudspeaker device according to claim 7, further comprising:

a screen that is detachably mounted on the first baffle plane and the second baffle plane of the loudspeaker device.

11. A loudspeaker device according to claim 10, wherein the screen is a Saran net.

12. The loudspeaker device according to claim 7, wherein the left and the right loudspeaker units share a common housing.

13. The loudspeaker device according to claim 7, wherein the left and the right loudspeaker units are physically connected.

14. The loudspeaker device according to claim 7, wherein the partition member is a single partition member.

15. The loudspeaker device according to claim 7, wherein the partition member is disposed perpendicular to the second baffle plane.

16. A loudspeaker device comprising:

left and right channel loudspeaker units which are disposed on left and right sides in close proximity to each other, and wherein the left and the right loudspeaker units propagate sound in a same direction of propagation, and the left and the right loudspeaker units are physically connected; and a partition member projecting forwardly in the direction of propagation of the sound from the loudspeaker units by a predetermined distance from a position between the loudspeaker units on a plane of a baffle on which the loudspeaker units are mounted, wherein the partition member projects from an enclosure of at least one of the loudspeaker units.

17. A loudspeaker device comprising:

left and right channel loudspeaker units of a full frequency range type or a middle and low frequency range type disposed in close proximity to each other on a first baffle plane, and wherein the left and the right loudspeaker units propagate sound in a same direction of propagation, and wherein the left and the right loudspeaker units are physically connected;

a loudspeaker unit, for low-frequency sound used commonly for left and right channels, mounted on a second baffle plane which is located forwardly in the direction of propagation of sound from the loudspeaker units from the first baffle plane; and a partition member disposed between said first baffle plane and said second baffle plane projecting forwardly in the direction of propagation of the sound from the first baffle plane and between the loudspeaker units of the respective channels of the full frequency range type or the middle and low frequency range type, wherein the partition member projects from an enclosure of at least one of the loudspeaker units.

* * * * *